US005195726A

United States Patent [19]

Kaner

[11] Patent Number: 5,195,726

[45] Date of Patent: Mar. 23, 1993

[54] PORTABLE LUGGAGE CARRIER

[75] Inventor: Albert Kaner, Bloomfield Hills, Mich.

[73] Assignee: AGC Research and Development Corp., Southampton, N.J.

[21] Appl. No.: 725,335

[22] Filed: Jul. 3, 1991

[51] Int. Cl.[5] ..... B66D 3/00

[52] U.S. Cl. ..... 254/325; 254/4 B; 414/347; 414/786

[58] Field of Search ..... 414/540–544, 414/347, 786; 254/4 R, 4 B, 325, 326; 212/187, 254, 265

[56] References Cited

U.S. PATENT DOCUMENTS

| | | | |
|---|---|---|---|
| 410,371 | 9/1889 | Moore | 212/265 X |
| 634,008 | 10/1899 | Lemley | 212/254 |
| 1,284,277 | 11/1918 | Ewig et al. | 212/187 |
| 1,354,501 | 10/1920 | Manley | 212/187 |
| 3,084,808 | 4/1963 | Peduzzi et al. | 212/254 X |
| 4,190,233 | 2/1980 | Godfrey | 254/4 B |
| 4,925,039 | 5/1990 | Macris | 212/265 X |
| 4,934,659 | 6/1990 | Yoke | 254/4 R X |

FOREIGN PATENT DOCUMENTS

| | | | |
|---|---|---|---|
| 373392 | 6/1990 | European Pat. Off. | 212/265 |
| 1273381 | 5/1972 | United Kingdom | 212/265 |

*Primary Examiner*—David A. Bucci
*Attorney, Agent, or Firm*—Gerald S. Rosen

[57] ABSTRACT

A compact, foldable, portable luggage carrier made of lightweight aluminum which when folded is light enough for easy hand carrying and storing. The apparatus is especially helpful for persons without sufficient strength to load luggage e.g., into an automobile trunk. The carrier is a rectangular platform on wheels with a handle structure containing a winch and pulley arrangement attached near one end of the platform. The handle structure comprises two upright posts attached at one end perpendicular to the platform and at the other end to the bottom ends of two additional posts supporting a winch, pulleys with a rope and hook for lifting the luggage and depositing it to a desired place, e.g. an automobile trunk and at the top end is a pulley arm parallel to the platform. The winch is manually or battery operated. The pulley arm's height from the platform is vertically adjusted by adjusting the top posts positions relative to the bottom posts. The platform fits under the rear of an automobile so the luggage can be deposited into the automobile trunk after it is lifted off the platform by the pulley hook and is lifted from the trunk and deposited onto the platform for transport to a desired location. The pulley structure is foldable to the upper posts which are foldable to the lower posts. The folded together posts are separable from or foldable onto the platform enabling the whole structure or each separable unit to be hand carried by the user to a desired location.

8 Claims, 7 Drawing Sheets

PORTABLE LUGGAGE CARRIER

BACKGROUND

This invention relates to a portable luggage carrier that has the capability of lifting the luggage for placement into a desired place such as an automobile trunk or onto an elevated area such as a raised platform, a bed and the like and is foldable and compact so that when not in use, it can be conveniently stored.

At the present time, various types of portable luggage carriers are in use, for example, the two-wheeled dolly type onto which luggage is strapped and wheeled from place to place. When the dolly reaches its destination, the luggage is unstrapped and carried to and placed in or on, e.g., an automobile trunk or a raised loading platform. In addition, the four-wheeled type of luggage carrier used by porters at airports, train stations and bus stations are used to carry luggage, to and from automobiles. None of the portable luggage carriers now in use provide a means as part of the carrier to mechanically lift the luggage to enable it to be placed at a desired location or into a storage area such as an automobile trunk. Such luggage carrier would make it easier for persons to, for example, load and unload luggage into and out of an automobile trunk, place such luggage on or take it off an elevated platform such as a loading dock or a bed or table for packing and unpacking, or even place the luggage in a storage locker and take it out. This type of luggage carrier would be especially useful for persons without sufficient strength to easily lift the luggage, such as certain elderly persons, children or handicapped persons.

SUMMARY OF INVENTION

This invention provides a portable luggage carrier that has means to lift luggage thereon onto a desired location and to return luggage from the desired location to the luggage carrier. Such locations are, for example, an automobile trunk, a loading platform, a bed or other convenient furniture for packing and unpacking luggage, a floor, a shelf and others readily apparent to those skilled in the art. The carrier is compact and foldable for ease of carrying and/or storing and can also be disassembled into two parts, if needed, for carrying and/or storing. Optionally, the carrier can have straps for holding down the luggage thereon.

A preferred means for lifting the luggage is a winch for raising and lowering a hook on the end of a rope. When in use, the hook is attached to the luggage handle for lifting and/or lowering. The winch can also be powered by a battery operated motor containing its own batteries or it can be plugged into an automobile cigarette lighter for power.

The portable luggage carrier of this invention is comprised of (a) a generally rectangular platform having wheels at the underside of the front corners thereof and at the underside of the rear corners thereof;

(b) an upright handle structure adapted to support a winch and pulley means foldably attached substantially perpendicularly to the platform on the rear top portion thereof for pushing, pulling and steering the carrier and also supporting a winch for use in pulling up and lowering a rope on pulleys, said rope being supported on an arm structure extending perpendicularly from the top of the handle structure and extending substantially parallel to and over the platform, said rope having a hook on the free end thereof for attaching to and lifting and lowering luggage at the other end thereof being attached to said winch, wherein said arm structure is foldably attached to the top of the upright handle structure and supports said pulleys.

The carrier is foldable and compact and has, at appropriate places, support elements which permit the carrier to be folded. Thus, for example, supports at the base of the handle structure and supports for the arm can each have one end which can be loosened or removed and a second end which can be loosened or removed, thus enabling the arm to be folded to the handle and the handle to be folded to the platform. If the carrier is too heavy for the user, the handle-arm structure can be removed by removing or loosening the second end of the handle supports, removing the handle structure and carrying that structure separately from the platform. The supports can be conventional supports similar to those used on foldable card tables to support the legs when the table is unfolded, or other conventional supports are suitable so long as they allow the carrier to be folded.

The platform, handle structure and arm structure are each preferably made from thinwall aluminum tubing preferably of rectangular shape and the supports can be made of sturdier aluminum or steel.

The general shape of the carrier is that of a four wheeled dolly. The carrier comprises an open platform of generally rectangular shape, although any convenient perimeter shape is suitable as long as it is stable when in use, e.g., its corners at the front can be rounded or right-angled. The platform has an upright handle structure at its back end. The corners of the platform are welded to form the perimeter frame of the platform and the cross beams, also made of aluminum tubing, are welded to the frame of the platform. The platform has no solid flooring, thus the cross beams must be sufficiently close so the luggage does not slip through. The platform is of sufficient size to hold one or more pieces of luggage such as suitcases, depending on the particular needs of the user. The platform is a frame of aluminum tubing making it light enough to be carried by the user. Preferably, the tubing has at least a flat top surface, but more preferably is rectangular in shape with the sides of wider dimensions forming the top and bottom surfaces thereof, and the cross beams are placed so they extend laterally in the frame. The upright handle structure comprising pairs of spaced apart tubing is foldably attached to the rear portion of the platform by supports for the tubing and, preferably at the rearmost beam, by flanges. The supports can be loosened and are attached at one end to the rearmost periphery of the platform and the other end to an upright tube of the upright handle structure, which upright tube structure is about ¾ the distance from the front toward the back of the platform, making the carrier stable when lifting and lowering luggage. The height of the upright structure can be adjusted to accommodate the distance the luggage is to be lifted. It can be adjusted to reach sufficient height so the luggage can be placed where desired. The means to accomplish the height adjustment can be a telescope type of movement or it can be by means of bolts in predrilled holes at various heights on the handle uprights which are attached at the bottom thereof to the platform and additional aluminum tubes attached at the top of said handle uprights. A winch with a latching mechanism is fixed to the additional tubing at a convenient height. The arm, which is a pair of spaced apart aluminum tubes extends over the platform and is substantially parallel thereto, and when fixed in the unfolded position, it is attached to the topmost part of the additional tubing by fastening means, preferably bolts which can be loosened, and by supports which can be loosened or removed, allowing the arm to fold to the lower uprights. The supports at one end are attached to the upper tubes about one third down from the top toward the bottom thereof and at the other end to the arm at about the midpoint thereof. A rope which has a hook on its front end is supported by a pulley attached to the arm at its front end and by a pulley attached to the arm at its juncture with the upright movable tube. The rope extends from the rear pulley to the winch and is attached thereto. The winch is used to wind up the rope when lifting luggage and to release the rope so the hook thereon goes downward when lowering luggage.

DETAILED DESCRIPTION

The invention can be best understood with reference to the drawings.

Figure 1:
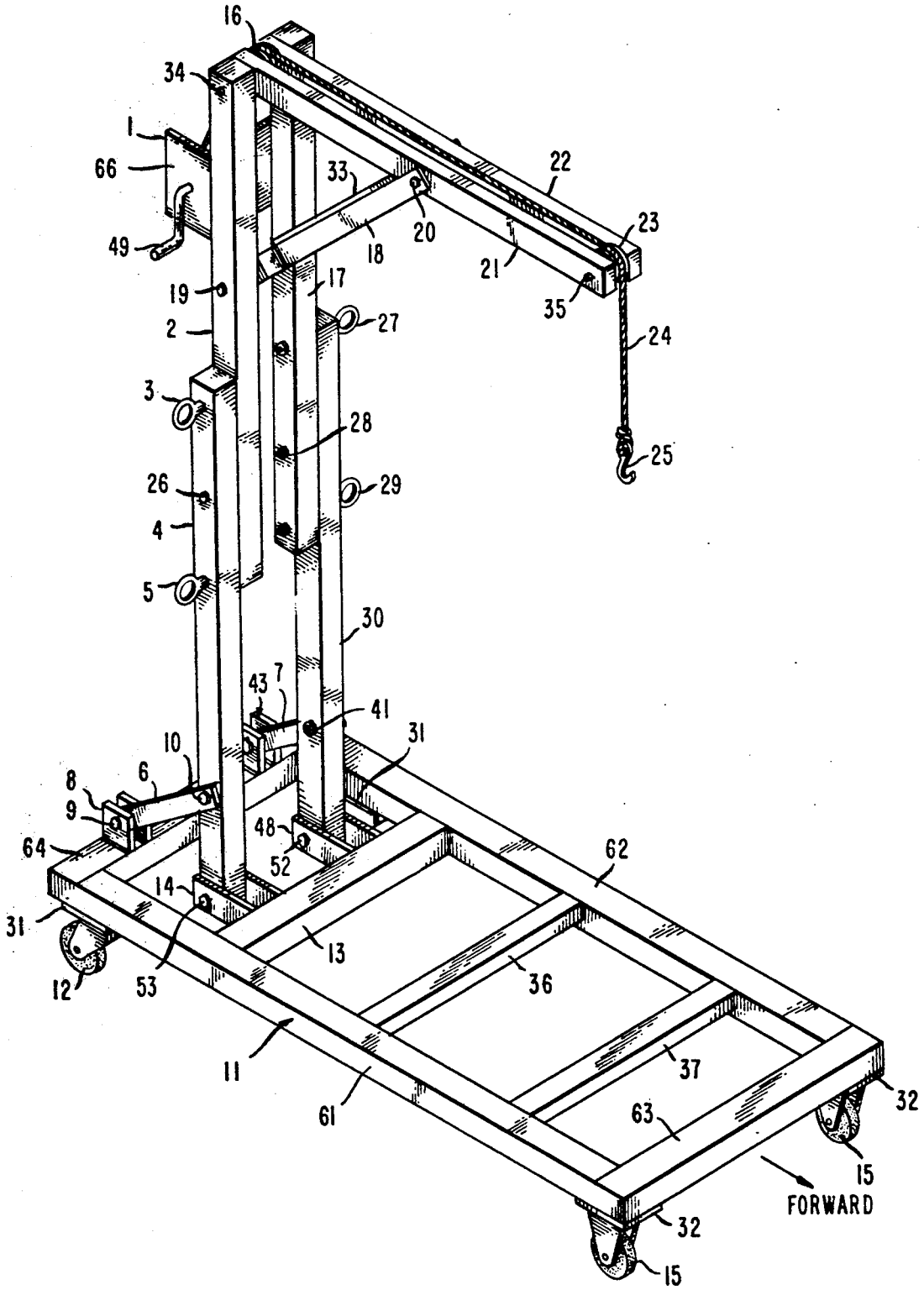
FIG. 1 is a perspective view of the luggage carrier of this invention, viewed at its right front corner.
Figure 3:
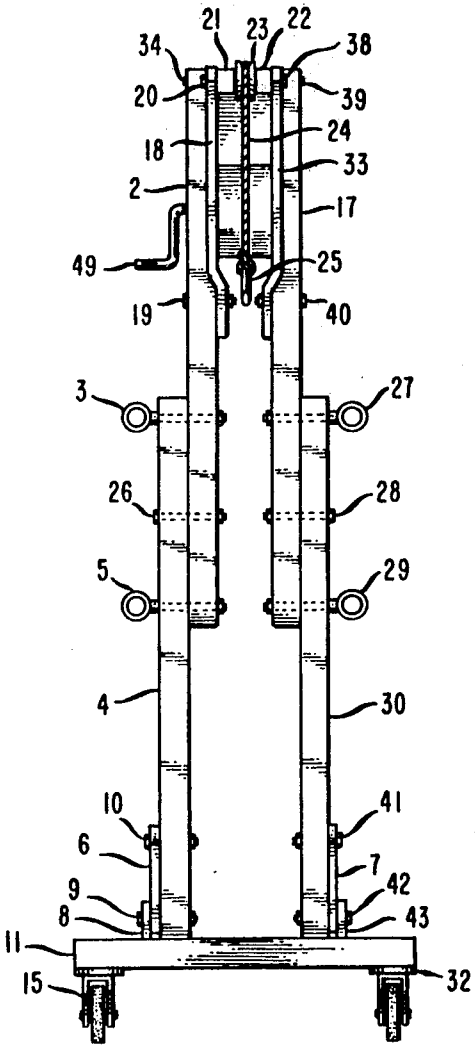
FIG. 3 is a front view of the luggage carrier.
Figure 2:
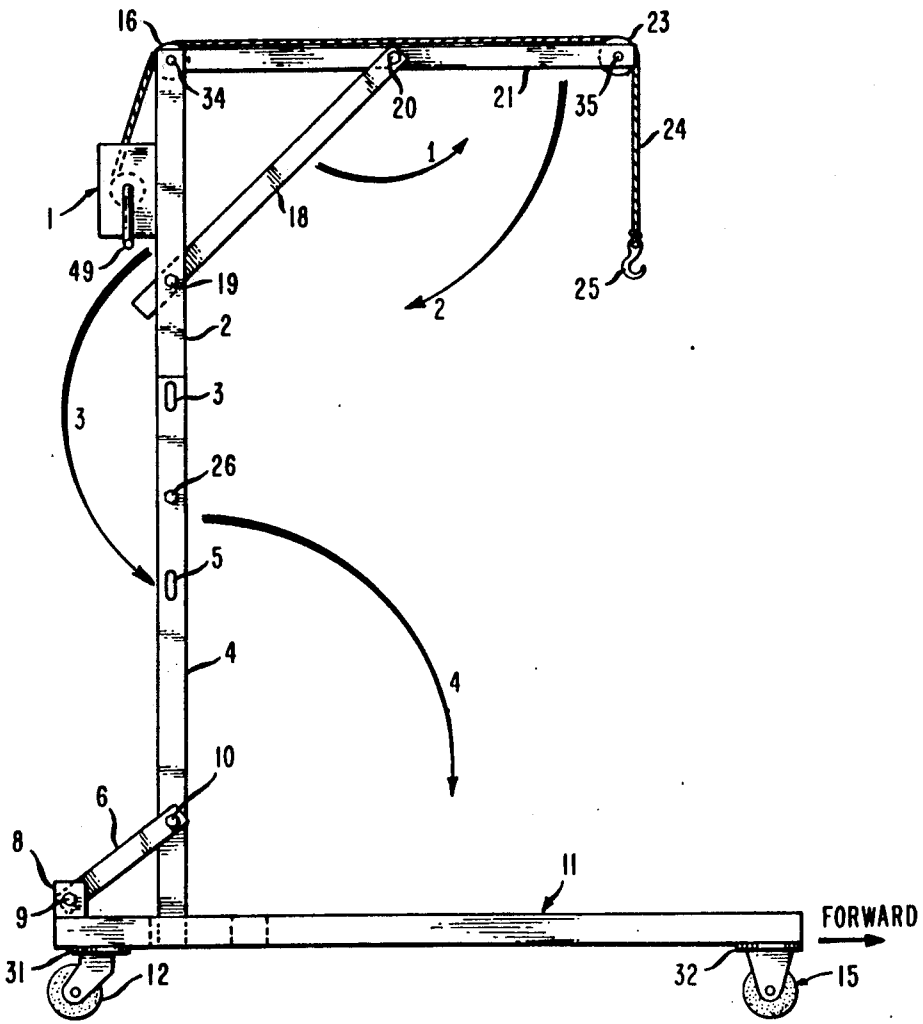
FIG. 2 is a side view of the luggage carrier with an arrow indicating its forward direction.

As shown in FIG. 1, which illustrates a preferred embodiment, an open platform frame 11 of the luggage carrier is a generally rectangular frame comprising two generally parallel sides 61 and 62, a front end 63 and a rear end 64. The front end 63 is fixedly attached at right angles by each end thereof to each of the sides 61 and 62 at the front thereof and the rear end 64 is fixedly attached at right angles by each end thereof to the rear or back end of each of the sides 61 and 62 so that the front end 63 and rear end 64 are essentially parallel. Intermediate the front end 63 of the frame 11 and the rear end 64 are several cross beams 37, 36 and 13 extending laterally within the frame 11 from the left side 61 to the right side 62. The cross beams 37, 36 and 13 are essentially parallel to the front end 63 and the rear end 64 and are spaced apart at distances which do not permit luggage such as suitcases and other conventional luggage to fall through the open floor of the platform 11.

The sides 61 and 62, the ends 63 and 64 and the cross beams 37, 36 and 13 which constitute the platform 11 are preferably made from thinwall aluminum tubing, and preferably of a rectangular shape such that the luggage thereon will not slip off and are strong enough so that the platform will not become distorted during use. More preferably, the sides 61 and 62, ends 63 and 64 and the cross beams 37, 36 and 13 are rectangular in shape with the top and bottom surfaces wider than the side surfaces. The materials used are lightweight for ease of handling and are shaped in the more preferable embodiment, as described, for strength. The tubings which constitute the platform 11 are fixedly attached as shown in the drawings by conventional means, preferably by welding.

Figure 8:
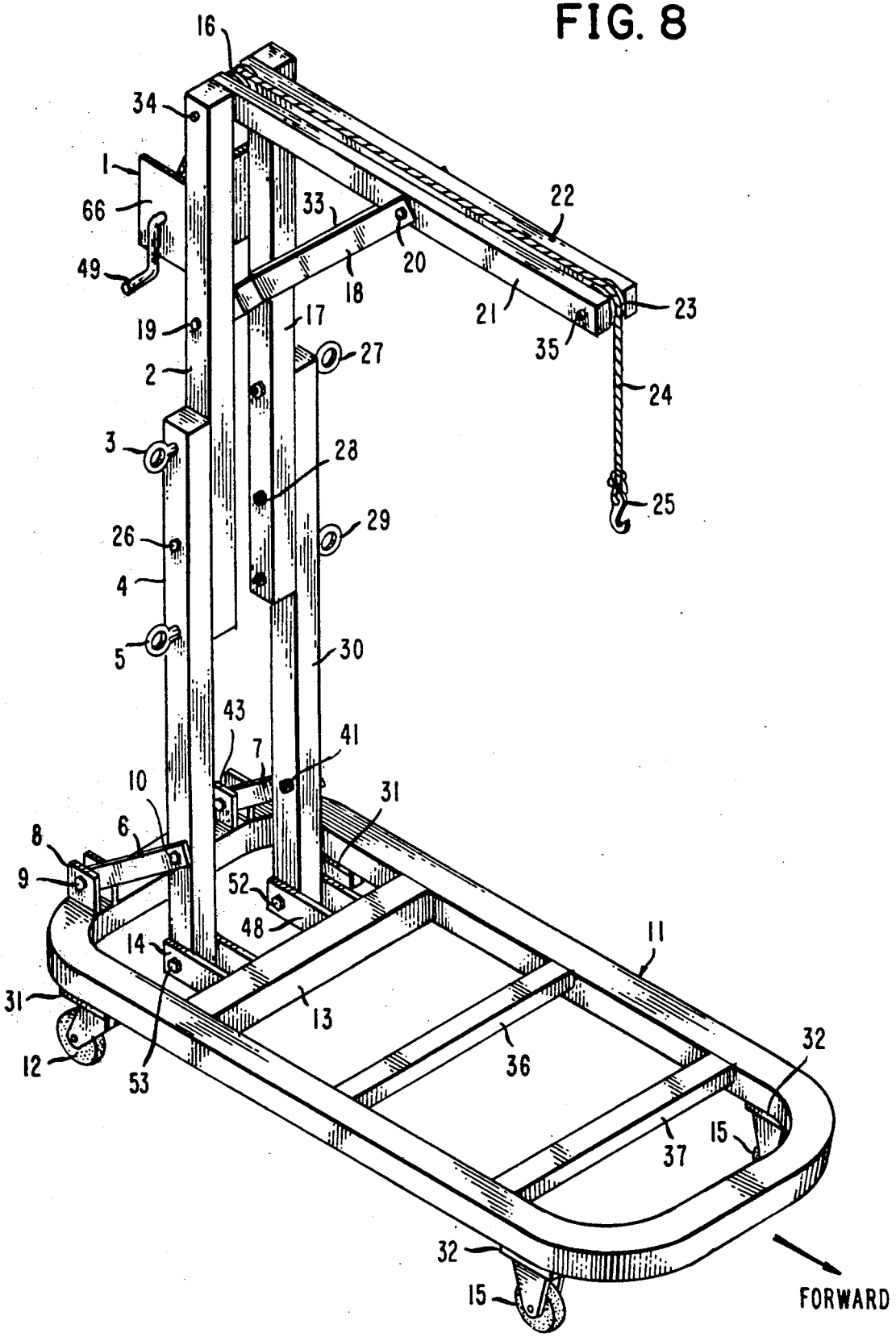
FIG. 8 is a perspective view of the luggage carrier viewed at the right front corner showing the embodiment in which the platform corners are rounded.

The shape of the perimeter of the platform 11 can be any convenient shape, e.g., rectangular as shown in FIG. 1, rounded corners as shown in FIG. 8, or any desirable shape so long as it maintains stability and resists being tipped over when in use.

On the underside of the platform 11, at each of its corners, are wheels which enable the carrier to be moved, e.g. pushed or pulled. In the preferred embodiment swivel casters 12 are at the rear corners and at the front corners are non-swivel wheels 15. The rear casters 12 are each attached to the underside of the frame 11 by plates 31 and the front wheels 15 are also attached to the underside of the platform frame 11 by plates 32. It is possible to have casters in the front as well as the back, or non-swivel wheels in the back and casters in the front, however, for ease of steering, swivel casters in the rear only are preferred.

The cross beams 37, 36 and 13 as illustrated in FIGS. 1, 4, 5*a*, 7 and 8 are spaced so that the frame 11 is divided into four approximately equidistant spaces from front to back, thus, the frontmost cross beam 37 is about one fourth the distance toward the rear 64 of the frame 11 measured from the front 63, the center cross beam 36 is about one half the distance between the front 63 and the rear 64 and the rearmost cross beam 13 is approximately three fourths the distance from the front 63 toward the rear 64 of the frame 11. Although the preferred embodiment has three cross beams, larger or smaller dimensioned units can have more or fewer cross beams, respectively.

On the rear side of the rearmost cross beam 13 are two fixed supports, a left support 14 and a right support 48 which are each made of lightweight aluminum and fixed by means of welding or bolts. The supports 14 and 48 are laterally inward about one third the length of the rearmost cross beam 13 to which they are attached. The left support 14 is laterally inward from the left side 61 and the right support 48 is laterally inward from the right side 62. The supports 14 and 48 each are shaped to receive a substantially rectangular aluminum tube so that such tube can stand perpendicularly on one end in the support, i.e., the left support 14 receives the left upright aluminum tube 4 and holds it in place with a nut 50 and bolt 53 and the right support receives the right upright aluminum tube 30 and holds it place with a nut 51 and bolt 52. The left upright tube 4 and the right upright tube 30 form the lower section of the handle, winch, pulley assembly.

Figure 9A:
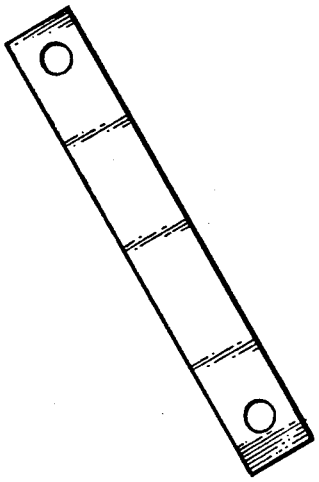
FIGS. 9*a*, 9*b* and 9*c* show various types of support members.
Figure 9B:
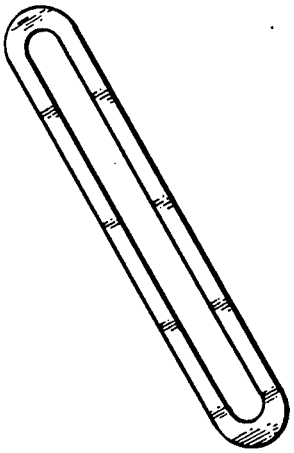
Figure 9C:
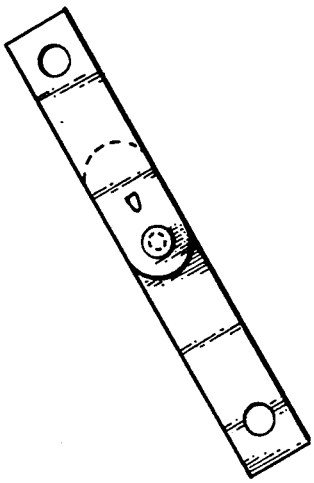

As can be seen in FIGS. 1, 2, 3, 6, 7 and 8, the left upright tube 4 is held in its upright position by a support means 6. The support means 6 can be, in its preferred embodiment, as shown, but can also be as illustrated in FIGS. 9*a*, 9*b* and 9*c*.

Referring now to the preferred embodiment, the left support member 6 is attached at one end to the left upright tube 4 by a fastening means 10 which can be easily loosened or removed by hand, and is attached at the other end to the left bracket 8 on the rear platform perimeter 64 by a fastening means 9 which can be easily loosened or removed. The front end of the support means 6 is sufficiently high to form at least a 45 degree angle with the plane of the platform 11. The left bracket 8 is situated on the rear perimeter 64 of the platform 11 directly in a straight line with the left support 14 for the left upright tube 4 so that the left support means 6 is essentially perpendicular to the rear surface of the left upright 4. The right upright tube 30 is similarly placed and held on the platform by a right support means 48 fixed onto the rear crossbar 13 and the upright tube 30 is held in an upright position by support means 7 attached to a right bracket 43 on the rear perimeter 64 of the platform 11 by a removable fastening means 42 and to the right upright tube 30 by a removable fastening means 41.

The upper portion of the left and right upright tubes 4 and 30 have a plurality of holes, preferably three, each of which are in the same relative position on the left and right upright tubes 4 and 30. The holes line up with holes in the lower portion of each of a left 2 and a right 17 aluminum tube which support a winch and pulley arrangement between them and form the upper upright structure. The holes are adapted for receiving fasteners which hold the upper left upright tube 2 against the inner surface of the lower left upright tube 4 and the upper upright tube 17 against the inner surface of the lower upright tube 30. In the usual conditions of use, the holes on the upper left upright and the upper right upright tubes 2 and 17 respectively, and the lower left upright tube 4 and the lower right upright tube 30 are matched respectively so each hole in each of the right and left pairs of uprights is matched. If the use of the luggage carrier of this invention requires the luggage to be lifted higher, then the upper uprights can be raised, leaving some holes unused, then attached to the lower uprights. The left tubes 4 and 2 are held together in normal use by the fasteners 3, 26 and 5 through the holes. The fasteners 3, 26 and 5 respectively are preferably hinge pins. The right upper tube 17 is similarly attached to the lower right upright tube 30 by similar fasteners, i.e. an upper fastener 27, a middle fastener 28 and a lower fastener 29.

Across the back of the left and right uprights 2 and 17 is fixed a winch 66 comprising a bracket 1 which is directly fixed to the back surfaces of each of the left and right uprights 2 and 17. The bracket 1 is shaped to receive a revolving axle 67 with a handle 49. The handle 49 is outside the bracket 1 and is for the purpose of turning the axle 67 which is attached to a rope 24 having a hook 25 on its free end. The winch 66 is in the upper portion of the upper upright tubes 2 and 17. The winch 66 also can be powered by a battery using either a cordless motor or a motor with a plug adapted to be plugged into a cigarette lighter of, e.g. an automobile, or other suitable outlet. The rope 24 is supported by a rear pulley 16 and a front pulley 23, each of which is in turn supported by two arms, a left arm 21, and a right arm 22, each of which is attached to the respective upper left upright 2 and upper right upright 17 by means of the axle 34 of the rear pulley 16 which passes through the left upper upright 2 at the top thereof and perpendicular to its axis to the right upper upright 17 through the left arm support 21 and the right arm support 22. At the front end of the support arms 21 and 22, a front pulley 23 is held in place by its axle 35 through the left arm 21 and the right arm 22. The support arms 21 and 22 are held perpendicular to the upright tubes 2 and 17 by a left support 18 and a right support 33. The arm supports 18 and 33 are fastened at their rear ends on the inside surface of the uprights 2 and 17 below the winch assembly 66 by removable fasteners 19 and 40 respectively. The front ends of the arm supports 18 and 33 are fastened to the respective arms 21 and 22 at approximately the midpoint of the arms 21 and 22 by removable fasteners 20 and 38, respectively, so that the supports 18 and 33 hold the arms parallel to the platform 11.

All the supports 6, 7, 18 and 33 are made from heavy gauge aluminum or steel.

Figure 4:
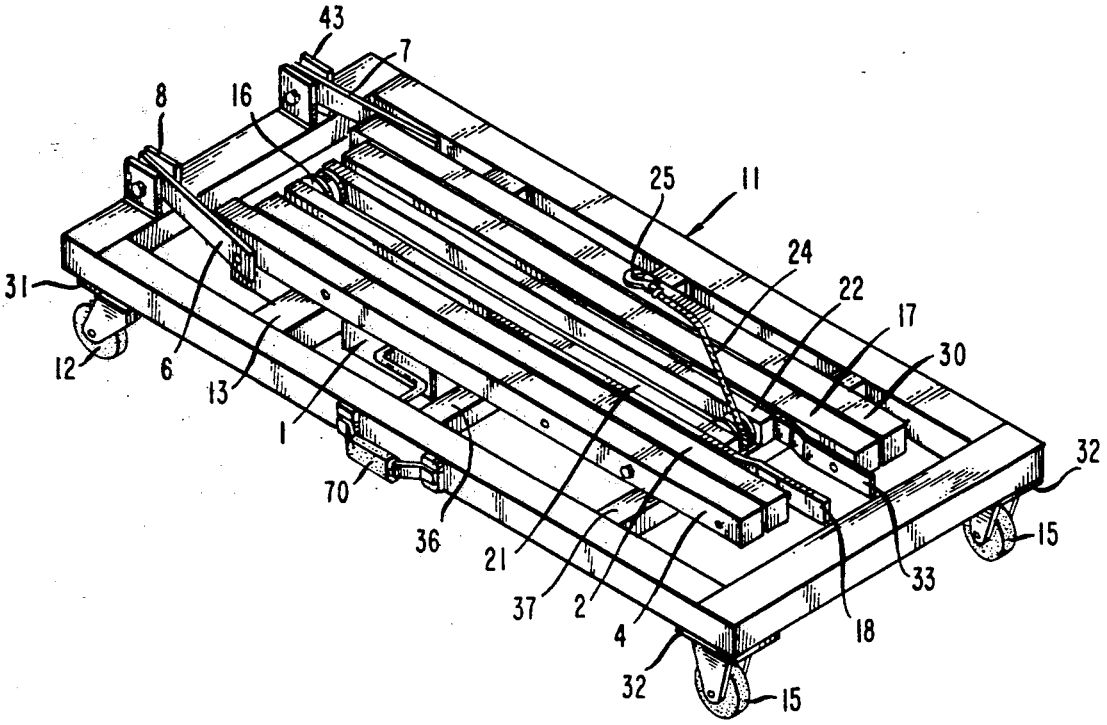
FIG. 4 is a top perspective view of the luggage carrier showing it in a folded position.

When the supports 6, 7, 18 and 33 are detached at one end, or loosened, depending on the specific structure thereof, the whole assembly folds in a relatively flat package, as shown in FIG. 4, convenient for carrying by a handle 70 attached to the outside surface of either of the side perimeter tubes 61, 62, of the platform 11.

Figure 5B:
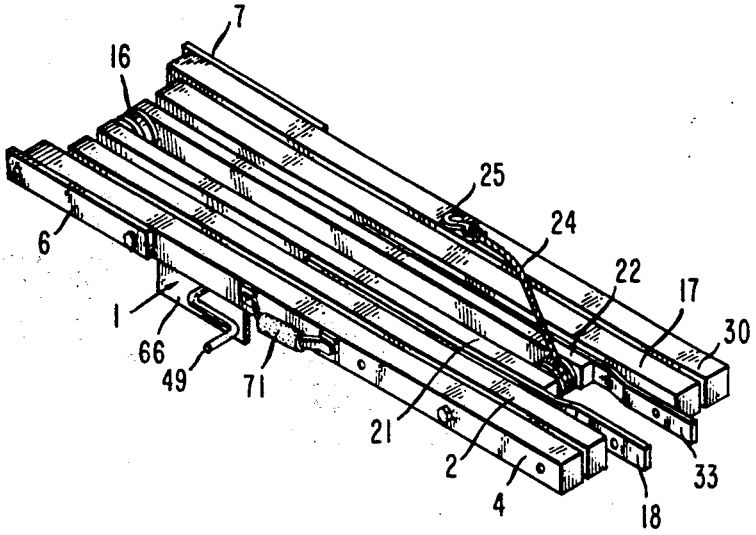
FIGS. 5*a* and 5*b* are views of the luggage carrier showing it disassembled into two parts for carrying.
Figure 5A:
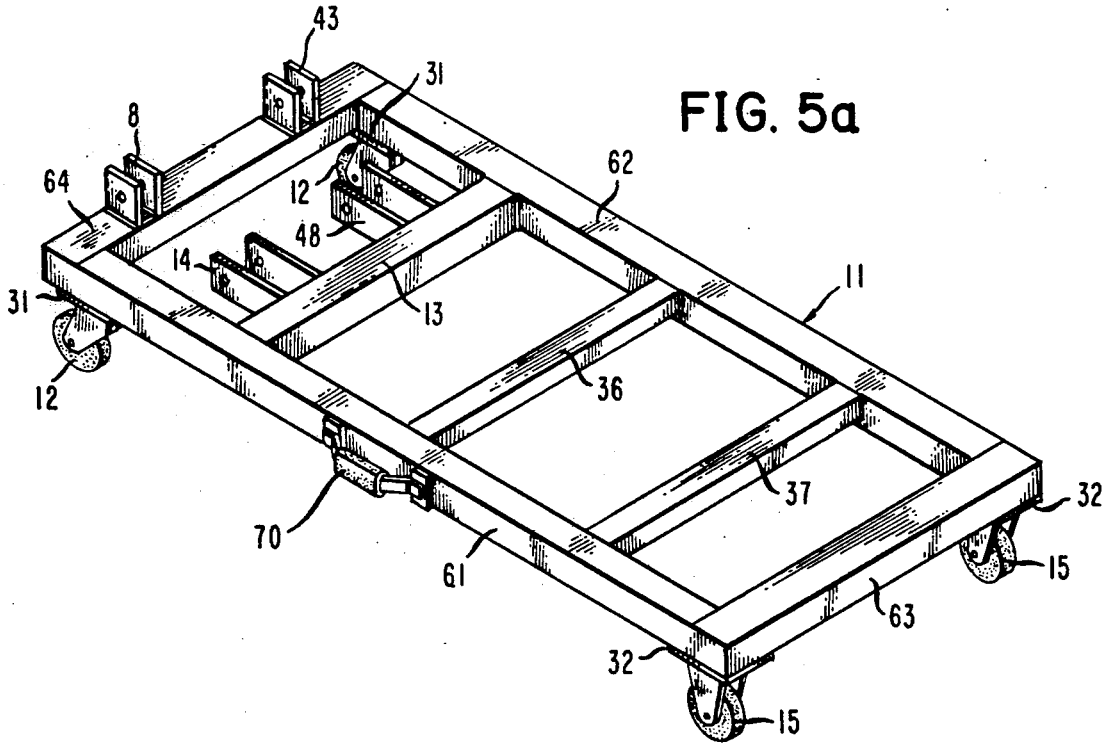

If desired, the lower supports 6 and 7 can be detached by removal of the fasteners 10 and 41 so the handle-winch-pulley assembly can be removed and carried separately as shown in FIGS. 5*a* and 5*b* which shows a handle 70 on the platform 11 left side 61 or right side 62 and a handle 71 on the outside surface of the upper uprights 2 or 17.

The configuration of the supports 6, 7, 18 and 33 can be any of the conventional supports known in the art. Shown in FIGS. 9*a*, 9*b* and 9*c* are three designs, FIG. 9*a* shows the support shown in the illustrated embodiment. FIG. 9*b* shows a design in which the fasteners for the supports need only be loosened, and not removed in order to permit folding of the luggage carrier. FIG. 9*c* shows a design similar to card table leg folding supports.

Figure 7:
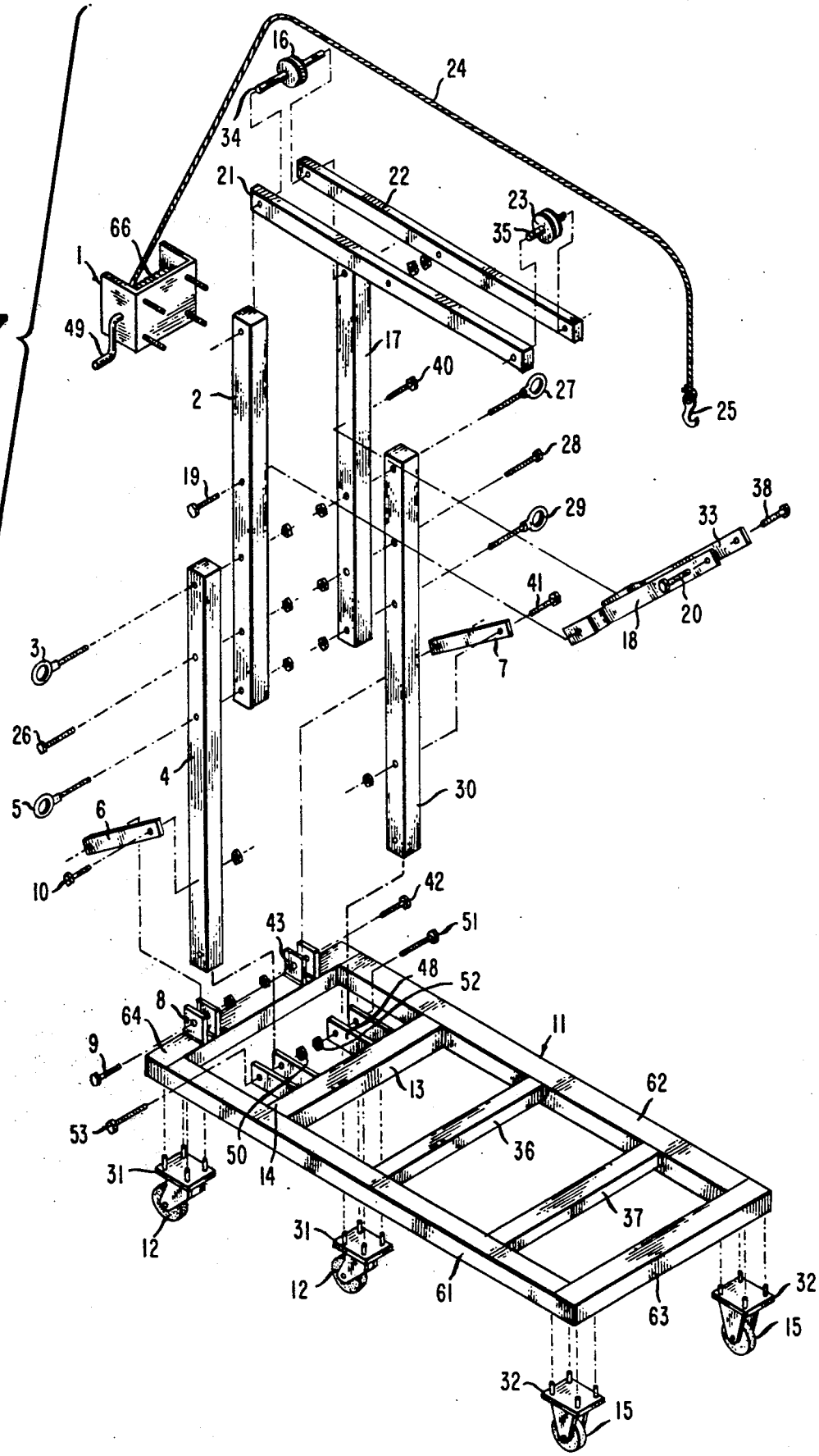
FIG. 7 is an exploded view of the preferred embodiment of the luggage carrier.

FIG. 7 shows the depicted embodiment in an exploded view wherein each part discussed herein is separately shown.

In FIG. 8, there is depicted a luggage carrier having rounded corners rather than right angled corners.

Figure 6:
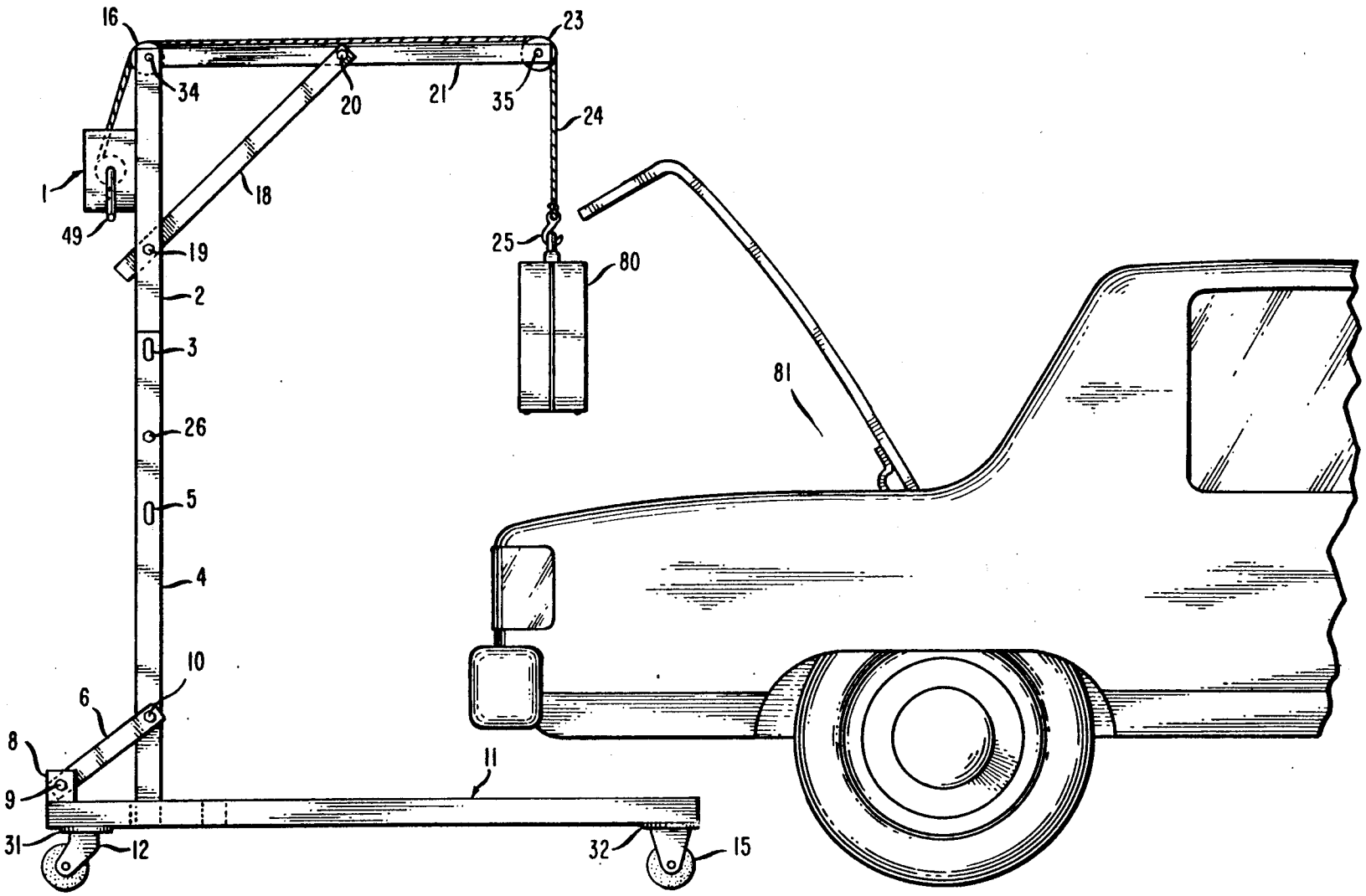
FIG. 6 is a side view of the luggage carrier showing it holding luggage about to be deposited into an automobile trunk.

FIG. 6 illustrates the invention in use.

The user loads the carrier with luggage 80 so it rests on the platform 11. The loading can be accomplished manually or the carrier can be pushed to an unloading or loading surface, e.g. a table or bed, with the platform 11 going under the table or bed. The winch 66 is unwound by turning its handle 49 either manually or by means of a battery powered motor until the hook 25 on the end of the rope 24 reaches the luggage handle or strap. The hook 25 is engaged onto the handle or strap and the winch handle 49 is turned in the opposite direction to lift the luggage 80 off the table or bed. The carrier is then pulled away from the bed or table and the luggage 80 is lowered unto the platform 11 by turning the winch handle 49. The hook 25 is either left engaged to the luggage or removed. The luggage 80 is transported via the carrier to the rear of an automobile with its trunk lid open. The luggage 80 is lifted, as described above, off the platform 11 using the hook 25 and winch 66. The carrier is then pushed so the platform 11 is at least partially under the rear of the automobile and the luggage 80 is above the bed of the open trunk of the automobile. The luggage 80 is then lowered, as described above, onto the floor of the automobile trunk. The hook 25 is disengaged from the luggage and the carrier is pulled away from the automobile after all the luggage is thus placed in the trunk for transport, e.g. to an airport. The carrier is folded as follows: The left and right supports 18 and 33, respectively, of the arm are unhooked at the points on the inside surfaces of the upper tubes 2 and 17 where they are attached by left and right fasteners 19 and 40, allowing the supports 18 and 33 to swing freely as shown by arrow 1 in FIG. 2. The arms 21 and 22 then are folded down toward uprights 2 and 17 as shown by arrow 2 in FIG. 2. Then the upper and lower pins 27 and 29 respectively connecting the lower right upright 30 to the upper right upright 17 are released and the middle pin 28 is loosened. The upper and lower pins 3 and 5 respectively connecting the lower left upright 4 to the upper left upright 2 are then released and the middle pin 26 loosened. This allows the upper uprights 2 and 17 and arms 21 and 22 folded thereto to pivot toward the rear of the platform 11 as shown by the arrow 3 in FIG. 2. Then the left and right lower uprights 4 and 30 respectively are released from the fasteners 9 and 42 respectively, allowing the supports 6 and 7 to swing freely. Then the lower uprights 4 and 30 with the upper uprights 2 and 17 respectively having the left and right arms 21 and 22 respectively folded thereon are folded onto the platform 11 in the direction of arrow 4 in FIG. 2. The resulting folded unit as shown in FIG. 4 is designed be easy to carry. If it is too heavy for the individual user, then the lower uprights 4 and 30 with the arms 21 and 22 and upper uprights 2 and 17 folded thereto can be removed from the platform 11 by removing the left and right bolts 53 and 51 which hold the lower uprights in the brackets 14 and 48 respectively attached to the rear side of the rearmost cross beam 13 and carried separately as shown in FIGS. 5*a* and 5*b*.

After the folded carrier is stored in the trunk of the automobile or other convenient location, the luggage and carrier are transported either in the same vehicle or separately to the destination where the carrier is reassembled by reversing the folding and disassembly steps described. The carrier is then ready for use to remove the luggage from the automobile trunk and transport it to, e.g. the airport porters or the baggage check-in counter. The carrier can be carried on board in a folded position or checked to the destination with the luggage. When the destination is reached, the luggage can be carried by the carrier of this invention previously prepared for use and placed in desired places, as described above.

The luggage carrier of this invention is compact, light-weight and foldable for ease of carrying and is designed to be adjustable so the luggage carried can be lifted to desired heights.

The invention as described can be modified by means conventional in the art and such modifications are intended to be covered, limited only by the appended claims

I claim:

1. A foldable, portable luggage carrier which can be hand carried having a platform with front and rear wheels and a handle structure which supports a winch and pulley attached to the platform comprising (a) a generally rectangular platform having wheels attached to the underside of each of the front and rear corners thereof and being sufficiently light-weight to enable it to be hand carried;

(b) an upright handle structure supporting a winch and a pulley structure, said upright handle structure removably and foldably attached substantially upwardly perpendicular to said platform at a position intermediate the location of the said rear wheels and a center line running from side to side of said platform, said handle structure comprising a first pair of spaced apart upright posts perpendicular to the platform and attached foldably and removably at one end to said platform, and each of said posts foldably attached at an end portion thereof not attached to said platform to one end portion of a second pair of upright posts which are substantially upwardly perpendicular to said platform, said second pair of upright posts having a winch supported between them and having attached at their ends not attached to said first pair of upright posts a pair of substantially parallel arms foldably attached to and extending substantially perpendicular therefrom over the platform in parallel relationship thereto and supporting pulleys at each end thereof with a rope or chain thereon, said rope or chain being attached at one end thereof to said winch and to a hook at an end thereof which is not attached to said winch, said handle structure being sufficiently light-weight to enable it to be hand carried to a desired location, either alone or folded to said platform.

2. A portable luggage carrier of claim 1 wherein the upright handle structure and wheeled platform are aluminum tubing.

3. A portable luggage carrier of claim 1 wherein the winch is battery powered.

4. A portable luggage carrier of claim 1 wherein the wheels thereof which are attached to the rear corners of said platform, are swivel casters.

5. A portable luggage carrier of claim 1 wherein the distance of the said parallel arms from the platform is adjustable by vertically varying the attachment position of the second pair of upright posts to the first pair of upright posts.

6. A method of folding and storing the portable luggage carrier of claim 1 which comprises the steps of (a) folding said parallel arms which support the pulley and are attached to the second pair of upright posts to the second pair of upright posts, (b) folding the second pair of upright posts with the parallel arms folded thereto to the first pair of upright posts, (c) removing the folded arms and posts structure from step (b) herein from the platform as a unit (d) hand carrying the separated folded structures from step (c) and said platform to a storage area and (e) placing the separated structures in said storage area.

7. A method of folding and storing the luggage carrier of claim 1 which comprises the steps of (a) folding said parallel arms which support the pulleys and are attached to the second pair of upright posts to the second pair of upright posts, (b) folding the second pair of upright posts with the parallel arms folded thereto to the first pair of upright posts, (c) folding the first pair of upright posts with the parallel arms and second pair of upright posts folded thereto to the floor of the platform, (d) hand carrying the folded structure from step (c) to a storage area and (e) placing the folded structure in said storage area.

8. A portable luggage carrier of claim 2 wherein the aluminum tubing of the platform is flat on its top surface.

* * * * *